US005153397A

United States Patent [19]

Seki et al.

[11] Patent Number: 5,153,397

[45] Date of Patent: Oct. 6, 1992

[54] GAS CIRCUIT BREAKER

[75] Inventors: Yasuharu Seki; Osamu Koyanagi; Masanori Tsukushi, all of Hitachi, Japan

[73] Assignee: Hitachi, Ltd., Tokyo, Japan

[21] Appl. No.: 670,862

[22] Filed: Mar. 18, 1991

[30] Foreign Application Priority Data

Mar. 19, 1990 [JP] Japan ..... 2-067067

[51] Int. Cl.[5] ..... H01H 33/88

[52] U.S. Cl. ..... 200/148 A

[58] Field of Search ..... 200/148 R, 148 A, 150 G, 200/148 B

[56] References Cited

U.S. PATENT DOCUMENTS 3,839,613 10/1974 Tsubaki et al. ..... 200/148 A
4,665,289 5/1987 Yanabu et al. ..... 200/148 A
5,072,084 12/1991 Seki et al. ..... 200/148 A

*Primary Examiner*—J. R. Scott

*Attorney, Agent, or Firm*—Antonelli, Terry, Stout & Kraus

[57] ABSTRACT

A gas circuit breaker comprising: a pair of contactors having separable contact portions, a nozzle arranged to surround the contact portions of the contactors so as to guide a flow of a gas; a puffer chamber for compressing the gas in response to a circuit breaking action and for supplying the compressed gas into the nozzle; and an exhaust passage in one of the contactors which is adjacent to the nozzle, the gas supplied from the puffer chamber being discharged through the exhaust passage. The exhaust passage includes a first passage formed in the one of the contactors so as to extend in the axial direction thereof and second passages communicating with and branching from the first passage and extending radially with respect to the axis of the one of the contactors at positions between gas discharging holes which are provided in the puffer chamber at a predetermined circumferential spacing. A projection formed of an arc-resistant member is provided on the branch connection between the first passage and the second passages.

6 Claims, 3 Drawing Sheets

GAS CIRCUIT BREAKER

BACKGROUND OF THE INVENTION

1. Field of the Invention

The present invention relates to a gas circuit breaker in which an electric circuit for a higher current is opened by the use of gas, and, more particularly, to a puffer type gas circuit breaker.

2. Description of the Related Art

In a puffer type gas circuit breaker, for example, as disclosed in U.S. Pat. No. 3,839,613 when a movable contactor is opened and travels from a fixed contactor, pressurized gas in a puffer cylinder operatively connected with the traveling of this movable contactor is blown against an arc formed between the movable contactor and the fixed contactor, with the gas flow being in the direction of traveling of the movable contactor and the reverse direction thereof. For this reason, the arc between the movable contactor and the fixed contactor is extinguished so as to break the current between these contactors.

In such a type of known gas circuit breaker, the pressurization of the gas in order to generate the arc-extinguishing gas is significant and, for this reason, the diameter of the puffer cylinder is large. Accordingly, a problem arises in that it is necessary to increase the driving force for driving the puffer cylinder. The gas which has extinguished the arc is heated by the arc and exhausted to the outside of the circuit breaker portion through an exhaust passage, with the gas flow having a high temperature thereby causing a problem of damaging the internal surface of the exhaust passage.

SUMMARY OF THE INVENTION

Aim underlying the present invention essentially resides in avoiding foregoing problems encountered in the prior art by providing a gas circuit breaker which can reduce the driving force thereof and increase reliability thereof against high temperature gas flow.

According to this invention, a gas circuit breaker is provided which comprises a pair of contactors having separable contact portions, with a nozzle surrounding the contact portions of the contactors so as to guide a flow of a gas. A puffer chamber compresses the gas in response to a circuit breaking action and for supplying the compressed gas into the nozzle. An exhaust passage is provided in one of the contactors which is adjacent to the nozzle, with the gas supplied to the nozzle being discharged through the exhaust passage and the nozzle. The exhaust passage includes a first passage formed in the one of the contactors so as to extend in the axial direction thereof and second passages communicating with and branching from the first passage and extending radially with respect to the axis of one of the contactors. The second passage serving as the exhaust passage and extends radially with respect to the axis of the contactor at positions between gas discharging holes which are provided in the puffer chamber at a predetermined circumferential spacing. A projection formed of an arc-resistant member is provided on the branch connection between the first passage and the second passages.

BRIEF DESCRIPTION OF DRAWINGS

The above object, features as well as advantages of the invention will become more apparent from the following description of preferred embodiments of the invention referring to the attached drawings, wherein.

DESCRIPTION OF PREFERRED EMBODIMENT

Figure 1:
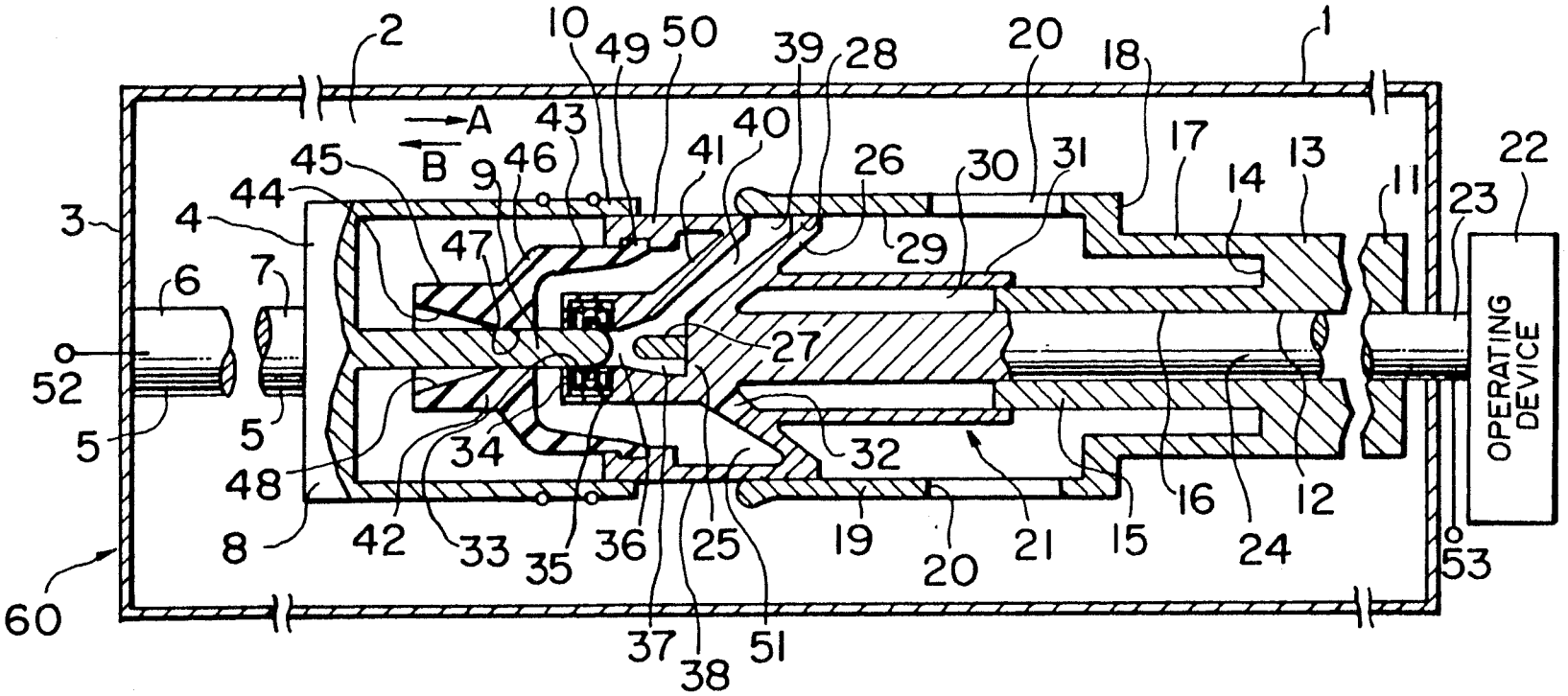
FIG. 1 is a sectional view of a preferred embodiment of a gas circuit breaker according to the present invention, illustrating a closed phase.
Figure 2:
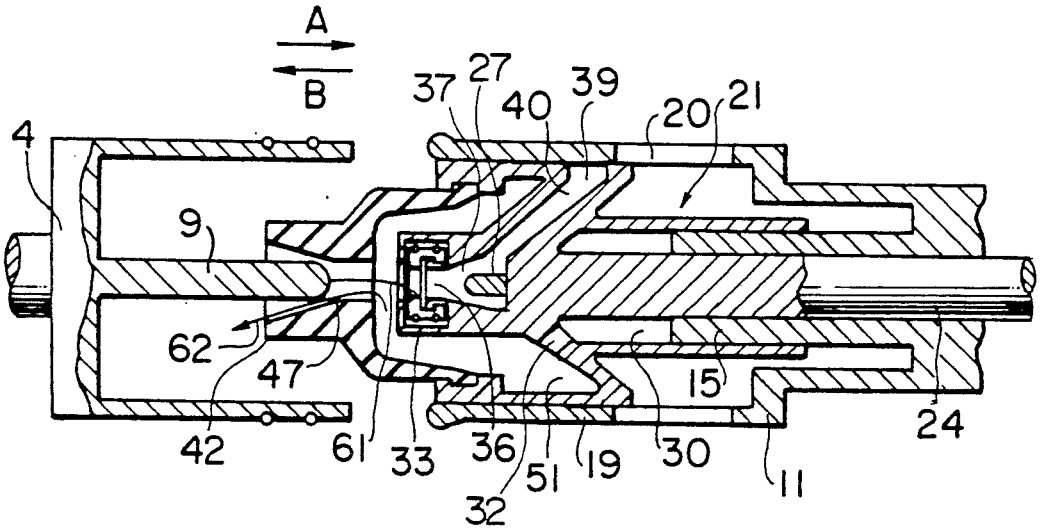
FIG. 2 is a sectional view illustrating an initial phase of the breaking operation of the gas circuit breaker shown in FIG. 1.
Figure 3:
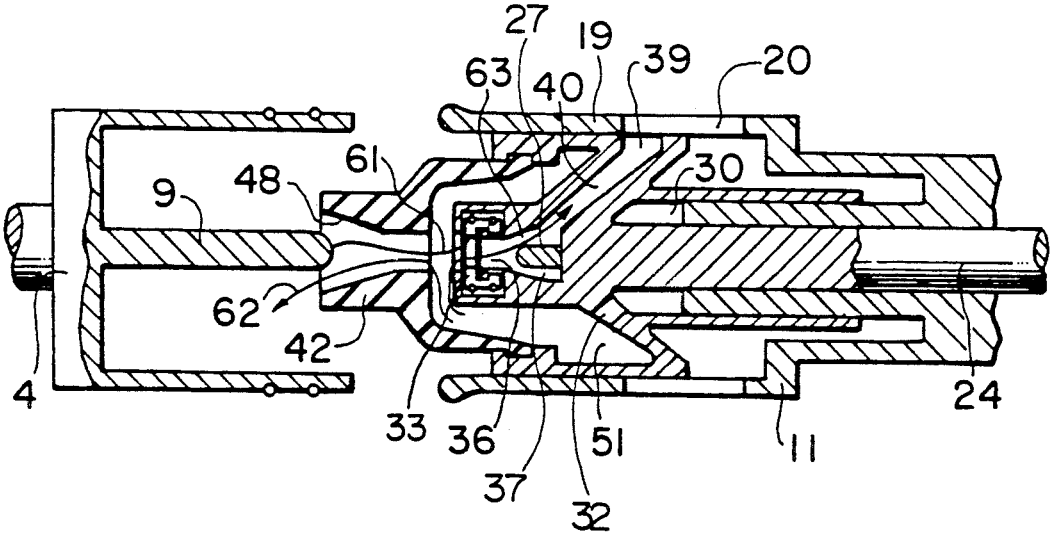
FIG. 3 is a sectional view illustrating an intermediate phase of the breaking operation of the gas circuit breaker shown in FIG. 1.

Referring now to the drawings wherein like reference numerals are used throughout the various views to designate like parts and, more particularly, to FIGS. 1–3, according to these figures, a gas circuit breaker constructed in accordance with the present invention includes a closed vessel 1 having an internal space 2 filled with an arc extinguishing gas such as $SF_6$. One end 6 of a shaft 5 is fixed to either end wall 3 of the closed vessel 1, with the shaft 5 forming a part of a stator body 4 made of conductive materials and with the end 6 being electrically insulated with respect to the other end wall 3. The stator 4 comprises a central stator, namely, a fixed arc contactor 9 extending from the center of a flange 8 in an axial direction designated by the arrow A, with the flange 8 being formed at the other end of the shaft 5, and a main stator 10 in the shape of a hollow cylindrical body extending from the periphery of the flange 8 in the axial direction A.

A frame 11 is fixed to and placed in the closed vessel 1 as is the case of the stator body 4. The frame 11 has a thick-walled cylindrical base 13 having a central bore 12. Hollow cylindrical puffer piston 15 is provided on the inner peripheral end portion The puffer piston 15 extends in an axial direction designated by the arrow B from the inner peripheral end portion 14. A bore 16 of the cylindrical puffer piston 15 and the central bore 12 have the same diameter and are concentric with each other. A hollow cylindrical portion 17 is provided on the outer periphery of the end portion of the cylindrical base 13 in a radial direction thereof, with the hollow cylindrical portion 17 including a middle diameter extending from the outer periphery in the axial direction B, a flange 18 extending radially outward from the end of hollow cylindrical portion 17, and a large-diameter cylindrical portion 19 extending from the outer periphery of the flange 18 in the axial direction B. A plurality of openings 20 are formed at a predetermined axial position of the large-diameter cylindrical portion 19, which serves as closing means, to be equi-spaced in the circumferential direction of the large-diameter cylindrical portion 19.

A movable portion 21 is made of a conductive material and is capable of moving in directions A and B with respect to the stator body 4. This movable portion 21 is fixed to an operating device 22 at one end 23 and is provided with an operating shaft portion 24. The shaft slidably, passes through the bores 12, 16 of the frame 11 and extends from the end 23 in the axial direction B. On the other end 25 of the operating shaft portion 24, there is provided a hollow truncated portion 26 extending radially outwardly from the end 25 in the direction B. The outer periphery 28 of the hollow truncated portion 26 is bent radially outward. In the closed phase of FIG. 1, the outer periphery 28 hermetically contacts the inner peripheral surface 29 of the large-diameter cylindrical portion 19 of the frame 11. On an intermediate portion of the inner surface of the hollow truncated portion 26, in order to form a cylindrical puffer chamber 30 in cooperation with the outer periphery of the shaft portion 24, there is provided a cylindrical portion 31 which serves as a puffer cylinder. The cylindrical portion 31 extends from the intermediate portion in the axial direction A and fits to the cylindrical puffer piston portion 15 of the frame 11. In the truncated portion 26 there are provided a plurality of holes 32 arranged at predetermined intervals and opening into the puffer chamber 30. When the movable portion 21 moves in the direction A with respect to the frame 11, the pressurized gas can flow from the puffer chamber 30 as the puffer piston section 15 plunges into the puffer chamber in the direction B.

In addition, from the end of the shaft portion 24, a hollow cylindrical movable contactor, namely, a movable arc contactor 33, extends in the axial direction. In the non-operating phase, namely, closed phase (FIG. 1), the cylindrical movable arc contactor 33 is fitted to the fixed arc contactor portion 9. When the movable portion 21 is moved in the direction A with respect to the stator body 4, electric contact between the movable portion 21 and the stator body 4 is interrupted. The movable arc contactor 33 is provided with a recess 34 at the outer peripheral surface on the pointed end thereof and a ring spring 35 is disposed in the recess 34.

From the outer periphery 28 of the hollow truncated portion 26, a large-diameter cylindrical portion 38, an end of which operates as a main movable contactor, extends axially. The large-diameter cylindrical portion 38 of the movable portion 21 is hermetically received in the large-diameter cylindrical portion 19 of the frame 11. On the largediameter cylindrical portion 38, there are provided a plurality of openings 39 at equal intervals in a circumferential direction near the outer peripheral portion 28. Between the openings 39 and the inner space 36 of the movable arc contactor 33 there are provided a first passage 37 extending along the exis of the shaft portion 24 and second passages 40 extending radially outwardly from the first passage 37. The second passages 40 are defined by the hollow truncated portion 26 and a plurality of inner walls 41 extending slantingly. The passages 40 are disposed between the holes 32 in the puffer chamber 30. The second passages 40 are slanted with respect to radial direction in order to smooth gas flow. Each second passage 40 serves as an exhaust passage and the opening 39 serves as an exhaust outlet.

A projection 27, made from arc resistant member, for example, Cu-W alloy, is provided at the junction between the first and second passages 37, 40 which operate as exhaust passages. This projection 27 provides thermal protection for the gas exhaust passage, particularly in the region where the second passages 40 branch from the first passages 37. The projection 27 also improves gas puffering against the arc. The projecting length of the projection 27 toward a side of the movable arc contactor 33 is determined in such a manner that the exhausting area of the first passage may not be decreased. The arc resistant member may be formed only on the tip end of the projection 27. A nozzle 42, made from an electric insulating material, includes a hollow large-diameter cylindrical portion 43, a small diameter nozzle body 45 having a nozzle hole 44, and an intermediate portion 46 combining the large-diameter portion 43 with the nozzle body 45. The nozzle hole 44 comprises a cylindrical hole portion 47 in the form of a throat hermetically receiving the fixed arc contactor 9, and a truncated hole portion 48 outside the cylindrical hole portion 47. One end 49 of the large-diameter portion 43 of the nozzle 42 is hermetically fitted to an inner groove of an enlarged end 50 of the large-diameter cylindrical portion 38 of the movable portion 21. The nozzle 42 cooperates with the large-diameter cylindrical portion 38 of the movable portion 21, an internal wall 41, the truncated portion 26, and the movable arc contactor 33, thereby defining an expansion chamber 51 for storing a gas which is heated and compressed by the arc.

The stator body 4 and the movable portion 21 are arranged in series in an alternating current line of, for example 50–60 Hz through terminals 52, 53. In a non-operating (closed) phase of a circuit breaker 60 having a structure as described above, as shown in FIG. 1, electric current flows between the terminals 52 and 53 through an electric connection between the fixed arc contactor 9 and the movable arc contactor 33 contacting therewith and also through the main stator 10 and the large-diameter cylindrical portion 38 of the movable portion 21 contacting therewith.

When electric connection is cut off between the terminals 52, 53, the circuit breaker 60 is operated as follows:

When a signal for breaking the current is sent to the operation device 22, the device 22 operates in response to the signal, so that the shaft portion 24 of the movable portion 21 is moved in the direction A with respect to the stator body 4 and the frame 11. This movement first electrically severs the electric connection between the main stator 10 and the large-diameter cylindrical portion 38 of the movable portion 21, but the fixed arc contactor 9 and the movable arc contactor 33 are held in contact with each other. As the movable portion 21 moves in the direction A, the gas pressure in the puffer chamber 30 and an expansion chamber 51 communicating therewith is increased.

When the shaft portion 24 further moves in the direction A, the fixed arc contactor 9 gradually separates from movable arc contactor 33. As a result, an arc discharge 61 commences between the fixed arc contactor 9 and the movable arc contactor 33. In the initial phase of the breaking operation, the cylindrical hole 47 of the nozzle 42 is still closed by the fixed arc contactor 9. Therefore, a movement of the cylindrical puffer piston 15 of the frame 11 into the puffer chamber 30 in the direction B causes a rise of the gas pressure not only in the puffer chamber 30 and the expansion chamber 51 but also in the chamber 36 of the movable arc contactor 33 communicating with the expansion chamber 51 and in the exhaust passage whose opening 39 is closed by the cylindrical portion 38 which serves as a closing means. Gas in the expansion chamber 51 as well as the chamber 36 in the movable arc contactor 33 is heated by the arc 61 produced between the fixed arc contactor 9 and the movable arc contactor 33, with the result that the gas pressure in the expansion chamber 51 and the like is increased.

When current to be interrupted is relatively small, the heating of gas conducted by the arc 61 is relatively small so that heating and pressurization of the gas by the arc 61 is insufficient. Pressurization of the chambers, 30, 51, 36 however attains certain level when the puffer piston 15 moves into the puffer chamber 30. Accordingly, as illustrated in FIG. 2, the movable portion 21 further moves toward a direction A. When the fixed arc contactor 9 is released from a cylindrical hole 47 in the nozzle 42, the gas portion for generating the arc 61 is cooled by the use of gas flow 62, namely, puffering of the gas flow 62 from the expansion chamber 51 through the cylindrical hole 47. As a result, the electric resistance of the gas portion is increased, and the arc discharge 61 is extinguished by the timing near zero cross of an alternating current where the arc 61 becomes slender, whereby the fixed arc contactor 9 is disconnected electrically from the fixed arc contactor 9.

In the circuit breaker 60, the exhaust passage is not formed in the shaft portion 24, unlike the known circuit breakers. The shaft portion 24 can therefore be formed with a relatively small diameter, and volume and weight reduction of the movable portion 21 can be realized. In addition, puffering of the gas is conducted in small amount against small current so that the puffer chamber 30 provided on the periphery of the relatively slender shaft portion 24 may be formed of a relatively small diameter. Accordingly, cross section of the puffer chamber 30 and, hence, the driving force for operating the device 22 can be reduced.

When current to be interrupted is large, as illustrated in FIG. 2, the heating and pressurization of gas by the arc 61 proceeds until the fixed arc contactor 9 is released from the cylindrical hole 47 of the nozzle 42. The arc discharge 61 is not stopped by the cooling generated only by puffering of the gas flow 62 passing through the cylindrical hole 47 of the nozzle 42. When the movable portion 21 moves further in the direction A, the breaking operation enters its middle phase in which, as illustrated in FIG. 3, the fixed arc contactor 9 is released from the truncated hole 48 of the nozzle 42. The exhaust hole 39 of the exhaust passage moves and fully communicates with the opening 20 of the large-diameter cylindrical portion 19 as the closing means. Consequently, the arc discharge 61 formed between the fixed arc contactor 9 and the movable arc contactor 33 is retracted and transferred to the projection 27 by the action of a double flow of the gas, namely, a gas flow 62 which is directed from the puffer chamber 30 and the expansion chamber 51 of elevated internal gas pressure through the cylindrical opening 47, and a gas flow 63 which is directed from the expansion chamber 51 through the chamber 36, exhaust passage and the opening 39. For this reason a generating direction of arc is not varied, so that puffering of gas against the arc can be uniform. As a result, the cooling of the arc by the gas is promoted and the arc is extinguished by timing of the zero cross of alternating current so that electrical connection between the fixed arc contactor 9 and the movable arc contactor 33 can be severed. The projection 27 not only suppresses the deviation of the arc mentioned above but also protects the branch connection between the first and the second passages 37, 40 from high temperature gas flow.

In the described circuit breaker 60, there is provided a different construction from the conventional one. Namely, the second passages 40 constituting the exhaust passage are arranged in radial outward direction between the puffer chamber 30 and the movable arc contactor 33. The length of the exhaust passage may be shortened regardless of the length of the puffer chamber 30. Accordingly, the flow resistance of the exhaust passage against the gas flow 63 discharged from the opening 39 through the exhaust passage may be reduced and a gas flow 63 at the timing, as illustrated in FIG. 3, may be sufficiently increased so that extinction of the arc 61 can be securely performed by the gas flow 63 cooperating with the gas flow 62. The projection 27 is formed at the branch connection between the first and the second passages 37, 40 which in combination form the exhaust passage. After the fixed arc contactor 9 and the movable arc contactor 33 are separated, the arc generated between the contactors 9, 33 is transferred to the gap between the fixed arc contactor 9 and the projection 27, so that deviation of the arc can be suppressed and the extinction of the arc can be improved. At the same time the branch connection between the first passage 37 and the second passage 40 can be protected from thermal effect exerted from the high temperature gas flow.

Figure 4:
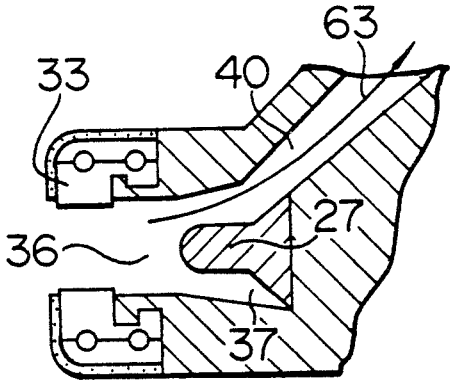
FIG. 4 is a sectional view of a movable electrode portion of another preferred embodiment of the present invention.

In a movable arc contactor of FIG. 4, A portion having a tapering surface is formed at the base of the projection 27 in this embodiment.

According to the embodiment of FIG. 4, the base of the projection 27 is smoothly connected to the interior surface of the second passage 40 constituting the exhaust section. Gas flow can be smoothly guided at the branch connection between first passage 37 and second passage 40. At the same time, the similar effect as mentioned above in first embodiment can be offered.

Figure 5:
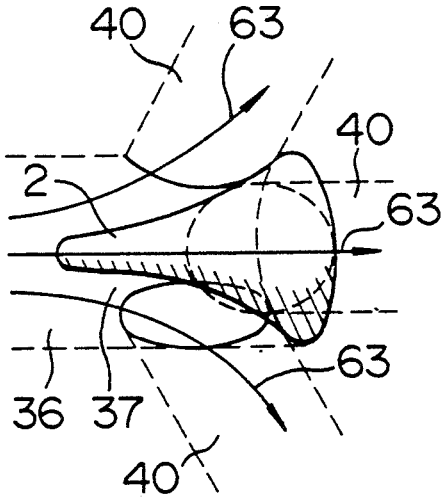
FIG. 5 is a sectional view of the movable electrode section of still another preferred embodiment according to the present invention.

In a movable arc contactor of the gas circuit breaker of FIG. 5, the projection 27 is in the shape of a horn. The projection 27 also may have a truncated shape and the like. The projection 27, however, preferably take the shape of a horn in order to obtain a sufficient passage cross-sectional area while reducing the passage resistance at the branch connection between first passage 37 and second passage 40 constituting the exhaust passage.

According to the embodiment of FIG. 5, gas flow can be more smoothly guided at the connection branch than in the embodiment of FIG. 4.

Figure 6:
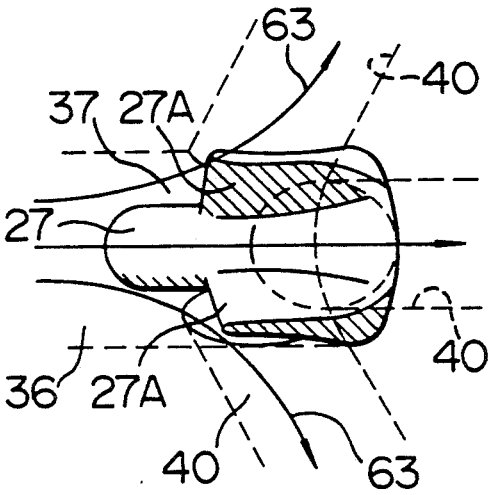
FIG. 6 is a sectional view of further preferred embodiment of the movable electrode section according to the present invention.

In a movable arc contactor of the gas circuit breaker of FIG. 6, gas flow plates 27A are provided on the outer periphery of the projection 27, with the gas flow plates 27A being arranged on the outer periphery of the projection 27 so as to separate the second passages 40 communicating with first passage 37.

The embodiment of FIG. 6 produces substantially the same effects as those produced by the preceding embodiments. At the same time the turbulent flow of the gas at the branch connection can be decreased so as to improve the discharge of the gas. Accordingly, circuit breaking capacity can be improved.

As will be understood from the foregoing description, according to the present invention, thermal effect caused by high temperature gas on the exhaust passage can be decreased and the deviation of arc position can also be prevented. Gas puffering against the arc can be thus uniformed so that gas circuit breakers excellent in large current breaking capacity can be provided.

What is claimed is:

1. A gas circuit breaker comprising:

a pair of contactors having separable contact portions;

a nozzle surrounding said contact portions of said contactor so as to guide a flow of a gas;

a puffer chamber for compressing said gas in response to a circuit breaking action and for supplying compressed gas into said nozzle; and an exhaust passage in one of said pair of contactors located adjacent to said nozzle, said gas supplied from said puffer chamber being discharged through said nozzle and said exhaust passage, wherein said exhaust passage includes a first passage formed in said one of said pair of contactors so as to extend in an axial direction thereof and second passages communicating with and branching from said first passage and extending radially with respect to an axis of said one of said pair of contactors, said second passages forming said exhaust passage being arranged radially with respect to an axis of said contactors at positions between gas discharging holes provided in said puffer chamber at a predetermined circumferential spacing, and wherein a projection is formed of an arc-resistant member and is provided on a branch connection between said first passage and said second passages, said branch connection being disposed in an area of said one of said pair of contactors, and said projection being adapted to transfer an arc generated between said one of said pair of contactors and the other of said pair of contactors to another arc generated between said other of said pair of contactors and said projection.

2. A gas circuit breaker according to claim 1, wherein said projection is includes a base, and wherein said base is provided with a portion having a tapering surface.

3. A gas circuit breaker according to claim 1, wherein said projection is horn-shaped.

4. A gas circuit breaker comprising:

a pair of contactors having separable contact portions;

a nozzle arranged to surround said contact portions of said contactor so as to guide a flow of a gas;

a puffer chamber for compressing said gas in response to a circuit breaking action and for supplying compressed gas into said nozzle; and an exhaust passage in one of said contactors which is located adjacent o said nozzle, said gas supplied from said puffer chamber being discharged through said nozzle and said exhaust passage;

wherein said exhaust passage includes a first passage formed in said one of said contactors so as to extend in an axial direction thereof and second passages communicating with and branching from said first passage and extending radially with respect to an axis of said one of said pair of contactors, said second passages constituting exhaust passage being arranged radially to the axis of said contactors at positions between gas discharging holes which are provided in said puffer chamber at a predetermined circumferential spacing, a projection formed of an arc-resistant member is provided on a branch connection between said first passage and said second passages, and wherein said projection is provided with a plurality of gas flow plates at a peripheral surface thereof.

5. A gas circuit breaker according to claim 4, wherein said gas flow plates are disposed so as to divide a gas passage adjacent to the branch connection into a plurality of sections.

6. A gas circuit breaker according to claim 1, wherein said second passages respectively have a length greater than a length of said first passage.

* * * * *